US011339343B2

(12) United States Patent
Filip et al.

(10) Patent No.: US 11,339,343 B2
(45) Date of Patent: May 24, 2022

(54) METHODS FOR BLENDING FUELS

(71) Applicant: BP Oil International Limited, Middlesex (GB)

(72) Inventors: Sorin Vasile Filip, Middlesex (GB); Amardeep Kaur Mudhar, Middlesex (GB); Nicolaas Richard Van Wezel, Middlesex (GB)

(73) Assignee: BP Oil International Limited, Sunbury on Thames (GB)

( * ) Notice: Subject to any disclaimer, the term of this patent is extended or adjusted under 35 U.S.C. 154(b) by 0 days.

(21) Appl. No.: 16/639,542

(22) PCT Filed: Aug. 13, 2018

(86) PCT No.: PCT/EP2018/071874
§ 371 (c)(1),
(2) Date: Feb. 14, 2020

(87) PCT Pub. No.: WO2019/034582
PCT Pub. Date: Feb. 21, 2019

(65) Prior Publication Data

US 2021/0130723 A1 May 6, 2021

(30) Foreign Application Priority Data

Aug. 14, 2017 (GB) ..... 1713023

(51) Int. Cl.
*C10L 10/10* (2006.01)
*C10L 1/06* (2006.01)
*C10L 1/233* (2006.01)

(52) U.S. Cl.
CPC ..... *C10L 10/10* (2013.01); *C10L 1/06* (2013.01); *C10L 1/2335* (2013.01);
(Continued)

(58) Field of Classification Search
CPC ..... C10L 10/10; C10L 1/06; C10L 1/2335; C10L 2200/04; C10L 2270/023; C10L 2300/20
See application file for complete search history.

(56) References Cited

U.S. PATENT DOCUMENTS 3,661,540 A 5/1972 Green et al.
9,315,759 B2 * 4/2016 Lange ..... C10L 1/233
2009/0318436 A1 * 12/2009 Albrecht ..... C07D 471/04 514/233.2

FOREIGN PATENT DOCUMENTS

GB 1071485 A 6/1967
GB 2308849 A 7/1997
(Continued)

OTHER PUBLICATIONS

Search Report under Section 17(5) for GB Application No. 1713023.8 dated Feb. 9, 2018, pp. 1-7.
(Continued)

*Primary Examiner* — Cephia D Toomer
(74) *Attorney, Agent, or Firm* — McDonnell Boehnen Hulbert & Berghoff LLP

(57) ABSTRACT

A method for preparing a refinery fuel composition having a target octane number, comprises: (i) blending fuel components in proportions which are designed to give a refinery fuel composition with an octane number which is greater than the target octane number by a margin of less than 1; and (ii) testing the octane number of the refinery fuel composition and, if the octane number falls below the target octane number, blending the refinery fuel composition with a non-metallic octane-boosting additive. A further method comprises: (a) passing a first refinery fuel composition comprising a non-metallic octane-boosting additive to a fuel handing system, and discharging the first refinery fuel com-
(Continued)

position from the fuel handing system; and (b) passing a second refinery fuel composition to the fuel handing system.

19 Claims, 5 Drawing Sheets

(52) U.S. Cl.
CPC ..... *C10L 2200/04* (2013.01); *C10L 2270/023* (2013.01); *C10L 2300/20* (2013.01)

(56) References Cited

FOREIGN PATENT DOCUMENTS

| | | | |
|---|---|---|---|
| JP | 2012017428 | A | 1/2012 |
| KR | 20120102381 | A | 9/2012 |
| WO | 2000077130 | A1 | 12/2000 |
| WO | 2017137514 | A1 | 8/2017 |
| WO | 2017137516 | A1 | 8/2017 |
| WO | 2017137518 | A1 | 8/2017 |
| WO | 2017137519 | A1 | 8/2017 |
| WO | 2017137521 | A1 | 8/2017 |

OTHER PUBLICATIONS

The International Search Report (ISR) with Written Opinion for PCT/EP2018/071874 dated Jan. 15, 2019, pp. 1-17.
United States Statutory Invention Registration, US H2135 H, Dec. 6, 2005, 10 pages.

* cited by examiner

METHODS FOR BLENDING FUELS

This application is a national stage application under 35 U.S.C. § 371 of International Application No. PCT/EP2018/071874, filed Aug. 13, 2018, which claims priority to Great Britain Patent Application No. GB 1713023.8, filed Aug. 14, 2017, the disclosures of which are explicitly incorporated by reference herein.

FIELD OF THE INVENTION

This invention relates to methods for preparing fuel compositions for a spark-ignition internal combustion engine. In particular, the invention relates to methods in which refinery fuel compositions comprising an octane-boosting additive are prepared.

BACKGROUND OF THE INVENTION

Spark-ignition internal combustion engines are widely used for power, both domestically and in industry. For instance, spark-ignition internal combustion engines are commonly used to power vehicles, such as passenger cars, in the automotive industry.

Combustion in spark-ignition internal combustion engines is initiated by a spark which creates a flame front. The flame front progresses from the spark-plug and travels across the combustion chamber rapidly and smoothly until almost all of the fuel is consumed.

Spark-ignition internal combustion engines are widely thought to be more efficient when operating at higher compression ratios, i.e. when a higher degree of compression is placed upon the fuel/air mix in the engine prior to its ignition. Thus, modern, high performance spark-ignition internal combustion engines tend to operate at high compression ratios. Higher compression ratios are also desired when an engine has a high degree of supplemental pressure boosting to the intake charge.

However, increasing the compression ratio in an engine increases the possibility of abnormal combustion including that of auto-ignition, particularly when the engine is pressure-boosted. A form of auto-ignition occurs when the end gas, typically understood to be the unburnt gas between the flame front and combustion chamber walls/piston, ignites spontaneously. On ignition, the end gas burns rapidly and prematurely ahead of the flame front in the combustion chamber, causing the pressure in the cylinder to rise sharply. This creates the characteristic knocking or pinking sound and is known as "knock", "detonation" or "pinking". In some cases, particularly with pressure-boosted engines, other forms of auto-ignition can even lead to destructive events known as "mega-knock" or "super-knock".

Knock occurs because the octane number (also known as the anti-knock rating or the octane rating) of the fuel is below the anti-knock requirement of the engine. Octane number is a standard measure used to assess the point at which knock will occur for a given fuel. A higher octane number means that a fuel/air mixture can withstand more compression before auto-ignition of the end gas occurs. In other words, the higher the octane number, the better the anti-knock properties of a fuel. Whilst the research octane number (RON) or the motor octane number (MON) may be used to assess the anti-knock performance of a fuel, in recent literature more weight is being given to the RON as an indicator of a fuel's anti-knock performance in modern automotive engines.

Accordingly, there is a need for fuels for spark-ignition internal combustion engines which have a high octane number, e.g. a high RON. There is a particular need for fuels for high compression ratio engines, including those utilising a high degree of supplemental pressure boosting to the intake charge, to have a high octane number so that higher engine efficiency may be enjoyed in the absence of knock.

In order to increase the octane number, octane improving additives are typically added to a fuel. Organometallic compounds, comprising e.g. iron, lead or manganese are well-known octane improvers, with tetraethyl lead (TEL) having been extensively used as a highly effective octane improver. However, TEL and other organometallic compounds are generally now only used in fuels in small amounts, if at all, as they can be toxic, damaging to the engine and damaging to the environment.

Octane improvers which are not based on metals include oxygenates (e.g. ethers and alcohols) and aromatic amines. However, these additives also suffer from various drawbacks.

For instance, N-methyl aniline (NMA), an aromatic amine, must be used at a relatively high treat rate (1.5 to 2% weight additive/weight base fuel) to have a significant effect on the octane number of the fuel. NMA can also be toxic.

Oxygenates give a reduction in energy density in the fuel and, as with NMA, have to be added at high treat rates, potentially causing compatibility problems with fuel distribution, fuel storage, fuel lines, seals and other engine components. Common oxygenates include alcohols such as ethanol, and ethers such as methyl tert-butyl ether (MTBE) and ethyl tert-butyl ether (ETBE). Due to its hygroscopic nature, ethanol is generally not used for boosting octane in refineries, but is typically blended with a fuel in a fuel terminal. Ethers, however, may be used within refineries to boost octane provided that the use of ethers is allowed by the fuel specification for the relevant market.

Oxygenates are typically used at treat rates of from 3% up to the maximum oxygen and/or oxygenate content permitted by the relevant fuel specification.

Additisation of a fuel with octane boosters is often carried out by refineries or other suppliers, e.g. fuel terminals or bulk fuel blenders, so that the fuel meets applicable fuel specifications when the base fuel octane number is otherwise too low.

Fuels blended in a refinery are usually made to a recipe that includes bulk gasoline components such as reformate, naphtha, butane etc. as well as an octane booster such as MTBE. The ratios of the different components are varied to ensure that the resulting fuel meets the applicable fuel specification in a particular market. In some markets, fuels are required to meet a target RON. Common target RONs for a fuel include 91 RON and 95 RON. In other markets, fuels are required to meet a target anti-knock index (AKI), which is the mean average of the RON and MON of the fuel (i.e. (RON+MON)/2).

To ensure that the target octane rating is achieved, the recipe for a fuel is designed to meet the target specification plus a certain margin. For example, a recipe for a fuel with a target RON of 95 will actually be designed to produce a fuel with a RON of 95.2. Such a recipe may look like 45% Reformate, 15% alkylate; 37% naphtha and 3% MTBE.

The size of the margin is dependent on the repeatability of the blending method and any other inefficiency in the systems, e.g. flow accuracy, in each refinery. However, it is usually assumed that where the margin is 0.2 above the target RON, the blend will land up between 95.0 and 95.4 (averaging 95.2).

At present, it is essential to include a margin when blending a fuel. This is because correction of a blend tested as off spec, i.e. not meeting the target specification, involves the additional of a large volume of bulk gasoline components, such as MTBE, alkylate, reformate, or all three depending on how tight the other specifications were. This costs time, holds up inventory and can constrain production.

However, by including a margin in the preparation of a fuel, octane-boosting components are commonly used in larger amounts than strictly necessary to meet the fuel specification (known as 'giveaway'). This can have a negative effect on the operational efficiency and therefore the financial performance of the refinery.

Another complication with blending fuels in a refinery arises when different fuels are required to meet different specifications. For instance, some regions may require fuels to meet more stringent octane number requirements, and so ethers such as MTBE and ETBE may be added in the refinery. However, other regions may prohibit the use of oxygenates in their fuels, and so it is essential that the refinery fuel remains free from MTBE, ETBE or other oxygenates.

To avoid contamination of non-oxygenate fuels with oxygenate components, it is necessary to use separate oxygenate and non-oxygenate tank systems in a refinery. This means that more equipment is required in a refinery, and that the flexibility associated with the equipment is low. Alternatively, the tank systems are flushed after use with oxygenate components to remove the 'heel' that remains in the tanks.

Accordingly, there is a need for a method for blending fuels for spark-ignition internal combustion engines that enables the fuels to be blended to a tighter octane number specification with less giveaway. There is also a need for a method for preparing fuels for spark-ignition internal combustion engines which enhances operational efficiencies in the refinery, by enabling the same systems (e.g. tanks and pipelines) to be used for oxygenate and non-oxygenate fuels.

SUMMARY OF THE INVENTION

Surprisingly, it has now been found that an octane-boosting additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon, provides a substantial increase to the octane number, particularly the RON, of a fuel for a spark-ignition internal combustion engine, even at low treat rates.

This enables a fuel to be blended with minimal octane number giveaway since, in those instances where the blended fuel does not meet a target octane number, just a small amount of the octane-boosting additive may be used to increase the octane number of the fuel to meet the target.

Accordingly, in a first aspect, the present invention provides a method for preparing a refinery fuel composition for a spark-ignition internal combustion engine, the refinery fuel composition having a target octane number, said method comprising:

(i) blending two or more refinery streams and optionally one or more fuel additives in proportions which are designed to give a refinery fuel composition with an octane number which is greater than the target octane number by a margin of less than 1; and (ii) testing the octane number of the refinery fuel composition and, if the octane number falls below the target octane number, blending the refinery fuel composition with an octane-boosting additive;

wherein the octane-boosting additive has a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

The octane-boosting additive may also be used in place of conventional oxygenate octane improvers, such as MTBE and ETBE, in a refinery. Since the octane-boosting additive has a low-oxygen content, separate fuel handling systems for oxygenate and non-oxygenate fuels are no longer be required.

Accordingly, in a second aspect, the present invention provides a method for preparing fuel compositions for a spark-ignition internal combustion engines, said method comprising:

(a) passing a first refinery fuel composition to a fuel handing system and discharging the first refinery fuel composition from the fuel handling system, the first refinery fuel composition being a blend of two or more refinery streams with an octane boosting additive and optionally one or more further fuel additives; and (b) passing a second refinery fuel composition to the fuel handing system, the second refinery fuel composition being a blend of two or more refinery streams and optionally one or more fuel additives;

wherein the octane-boosting additive has a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

BRIEF DESCRIPTION OF THE FIGURES

FIG. 1*a* shows a graph of the change in octane number of an E0 fuel having a RON prior to additisation of 90; FIG. 1*b* shows a graph of the change in octane number of an E0 fuel having a RON prior to additisation of 95; and FIG. 1*c* shows a graph of the change in octane number of an E10 fuel having a RON prior to additisation of 95.

FIG. 2*a* shows a graph of the change in octane number of an E0 and an E10 fuel against treat rate; FIG. 2*b* shows a graph of the change in octane number of an E0 fuel at a treat rate of 0.67% w/w; and FIG. 2*c* shows a graph of the change in octane number of an E10 fuel at a treat rate of 0.67% w/w.

DETAILED DESCRIPTION OF THE INVENTION

Preparation Methods

Figure 1A:
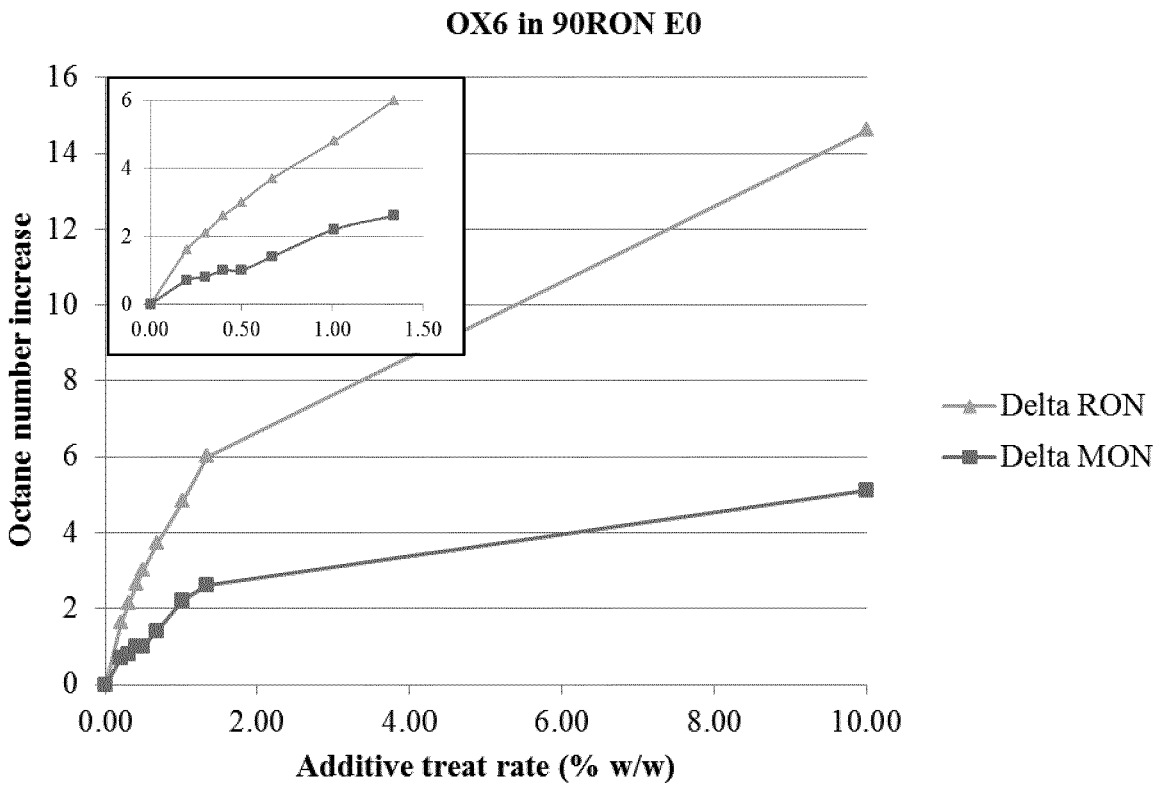
FIGS. 1*a-c* show graphs of the change in octane number (both RON and MON) of fuels when treated with varying amounts of an octane-boosting additive described herein. Specifically.

The methods of the present invention are used to prepare fuel compositions for use in spark-ignition internal combustion engines.

In a first aspect, the present invention provides a method for preparing a refinery fuel composition having a target octane number. The method comprises:

(i) blending two or more refinery streams and optionally one or more fuel additives in proportions which are designed to give a refinery fuel composition with an octane number which is greater than the target octane number by a margin of less than 1; and (ii) testing the octane number of the refinery fuel composition and, if the octane number falls below the target octane number, blending the refinery fuel composition with an octane-boosting additive described herein.

In preferred embodiments, the refinery streams and, where used, fuel additives are blended in proportions which are designed to give an octane number which is greater than the target octane number by a margin of less than 0.5, more preferably less than 0.2, still more preferably less than 0.1, and most preferably 0.0. Thus, the method minimises the octane number giveaway associated with the fuel.

Proportions which are designed to give a fuel with a particular octane number may be readily determined by a person of skill in the art, and will be dependent on a number of factors, including the nature of the fuel specification which is being met, the type, quality and volume of the different refinery streams and octane improvers that are available.

An octane improver may be blended with the refinery streams. Suitable octane improvers are described below. Preferably, the octane improver is selected from non-metallic octane improvers and the octane-boosting additives described herein, and more preferably from ether octane improvers (e.g. MTBE, ETBE and TAME) and the octane-boosting additives described herein.

The method of the invention involves testing the octane number of the refinery fuel composition and, if the octane number falls below the target octane number, blending the refinery fuel composition with an octane-boosting additive described herein. Preferred octane-boosting additives are described below.

The octane-boosting additive described herein is preferably blended with the fuel composition in an amount sufficient to increase the octane number of the fuel to at least the target octane number.

Since the octane-boosting additives described herein are effective at low treat rates, then they can be used at ppm levels. This is contrast to traditional octane improvers, such as MTBE and ETBE, which are typically used at much higher levels. Thus, the octane-boosting additive described herein may be blended with the refinery fuel composition in an amount of less than 5000 ppm, preferably less than 3000 ppm, more preferably less than 2000 ppm, and still more preferably less than 1500 ppm, by total weight of the refinery streams. The octane-boosting additive described will typically be used in amounts of greater than 500 ppm.

The target octane number may be a target research octane number (RON) or a target motor octane number (MON), though it is preferably a target RON. The target RON may take a value of from 90 to 105. Preferably, the target RON takes a value selected from 90, 91, 93, 95, 97, 98, 99, 100 and 102, and more preferably a value selected from 93, 95, 98, 100 and 102.

The target octane number may also be a target anti-knock index (AKI). The target AKI preferably takes a value of from 85 to 100. Preferably, the target AKI takes a value selected from 87, 89, 91 and 93.

It will be appreciated that the nature of octane number that is tested is the same as that used for the target octane number. For example, the RON of the refinery fuel composition will be tested in instances where the target octane number is a target RON, and the AKI of the refinery fuel composition will be tested in instances where the target octane number is a target AKI.

The RON and MON of the fuel may be tested according to ASTM D2699-15a and ASTM D2700-13, respectively. The AKI of a fuel may be readily derived from the RON and MON of the fuel, using the following formula: (RON+MON)/2.

Once the refinery fuel composition having a target octane number has been prepared, it may be used in a spark-ignition internal combustion engine, or it may be blended with one or more further components as described below (e.g. one or more fuel additives, or alcohols such as ethanol) into a fully formulated fuel. The fully formulated fuel may then be used in a spark-ignition internal combustion engine.

In a second aspect, the present invention provides a method for preparing fuels for use in spark-ignition internal combustion engines, said method comprising:

(a) passing a first refinery fuel composition to a fuel handing system and discharging the first refinery fuel composition from the fuel handing system, the first refinery fuel composition being a blend of two or more refinery streams with an octane boosting additive described herein and optionally one or more further fuel additives; and (b) passing a second refinery fuel composition to the fuel handing system, the second refinery fuel composition being a blend of two or more refinery streams and optionally one or more fuel additives.

Step (a) of the method may comprise blending two or more refinery streams with an octane-boosting additive and optionally one or more further fuel additives to form the first refinery fuel composition.

Step (b) of the method may comprise blending two or more refinery streams and optionally one or more fuel additives to form the second refinery fuel composition. Step (b) of the method may further comprise discharging the second refinery fuel composition from the fuel handing system.

The fuel handling system may be any system into which the fuel may be passed, e.g. for transportation or storage, and from which the fuel may be discharged. Particularly relevant fuel handling systems in the present invention are storage tanks and pipelines. Preferably, the fuel handling system is a storage tank.

It will be appreciated that the second refinery fuel composition is passed to the fuel handing system after discharge of the first refinery fuel composition without flushing of the fuel handing system in between. Although the second refinery fuel composition may therefore be contaminated with a small amount of octane-boosting additive described herein, the low-oxygen content of the additive means that the second refinery fuel composition may nonetheless be used in a non-oxygenate fuel.

Preferred octane-boosting additives are described in greater detail below.

The first refinery fuel composition may contain the octane-boosting additive described herein in an amount of up to 20%, preferably from 0.05% to 10%, and more preferably from 0.08% to 5% weight additive/total weight of the refinery streams. Even more preferably, the first refinery fuel composition contains the octane-boosting additive in an amount of from 0.1% to 1%, and even more preferably still from 0.1% to 0.5% weight additive/total weight of the refinery streams. It will be appreciated that, when more than one octane-boosting additive described herein is used, these values refer to the total amount of octane-boosting additive described herein in the first refinery fuel composition.

Preferably, the first and second refinery fuel compositions do not contain MTBE, ETBE, TAME, THEME, TAEE or DIPE. More preferably, the first and second refinery fuel compositions do not contain any oxygenates (i.e. compounds which contain oxygen, such as alcohols or ethers), other than the low-oxygen octane-boosting additive described herein that is used in the first refinery fuel composition.

Once the first and second refinery fuel compositions have been prepared, they may be used in a spark-ignition internal combustion engine, or they may be blended with one or more further components as described below (e.g. one or more fuel additives, or alcohols such as ethanol) into a fully formulated fuel. The fully formulated fuel may then be used in a spark-ignition internal combustion engine.

In preferred embodiments, the method may further comprise passing blending one of the first and second refinery fuel compositions, and preferably the first refinery fuel composition, with an oxygenate component once it has been discharged from the fuel handing system to form an oxygenate fuel. The oxygenate component is preferably an alcohol, e.g. as described below, and is most preferably ethanol.

Where steps (a) and (b) of the method are carried out in a refinery, then blending of the first or second refinery fuel with an oxygenate is preferably carried out once the first or second refinery fuel has left the refinery. For example, alcohol blending may be carried out at a fuel terminal. This means that contamination in fuel distribution pipelines is avoided.

The other of the first fuel and second refinery fuels is preferably used in (e.g. by being used as, or by being blended into a fully formulated fuel composition which is used as) a non-oxygenate fuel.

Octane-Boosting Additive

The octane-boosting additive that may be used in the methods of the present invention has a chemical structure comprising a 6-membered aromatic ring sharing two adjacent aromatic carbon atoms with a 6- or 7-membered otherwise saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon (referred to in short as an octane-boosting additive described herein). As will be appreciated, the 6- or 7-membered heterocyclic ring sharing two adjacent aromatic carbon atoms with the 6-membered aromatic ring may be considered saturated but for those two shared carbon atoms, and may thus be termed "otherwise saturated."

Alternatively stated, the octane-boosting additive used in the present invention may be a substituted or unsubstituted 3,4-dihydro-2H-benzo[b][1,4]oxazine (also known as benzomorpholine), or a substituted or unsubstituted 2,3,4,5-tetrahydro-1,5-benzoxazepine. In other words, the additive may be 3,4-dihydro-2H-benzo[b][1,4]oxazine or a derivative thereof, or 2,3,4,5-tetrahydro-1,5-benzoxazepine or a derivative thereof. Accordingly, the additive may comprise one or more substituents and is not particularly limited in relation to the number or identity of such substituents.

Preferred low-oxygen additives have the following formula:

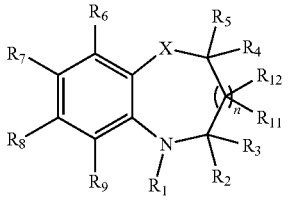

where: $R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

In some embodiments, $R_2$, $R_3$, $R_4$, $R_5$, $R_{11}$ and $R_{12}$ are each independently selected from hydrogen and alkyl groups, and preferably from hydrogen, methyl, ethyl, propyl and butyl groups. More preferably, $R_2$, $R_3$, $R_4$, $R_5$, $R_{11}$ and $R_{12}$ are each independently selected from hydrogen, methyl and ethyl, and even more preferably from hydrogen and methyl.

In some embodiments, $R_6$, $R_7$, $R_8$ and $R_9$ are each independently selected from hydrogen, alkyl and alkoxy groups, and preferably from hydrogen, methyl, ethyl, propyl, butyl, methoxy, ethoxy and propoxy groups. More preferably, $R_6$, $R_7$, $R_8$ and $R_9$ are each independently selected from hydrogen, methyl, ethyl and methoxy, and even more preferably from hydrogen, methyl and methoxy.

Advantageously, at least one of $R_2$, $R_3$, $R_4$, $R_5$, $R_6$, $R_7$, $R_8$, $R_9$, $R_{11}$ and $R_{12}$, and preferably at least one of $R_6$, $R_7$, $R_8$ and $R_9$, is selected from a group other than hydrogen. More preferably, at least one of $R_7$ and $R_8$ is selected from a group other than hydrogen. Alternatively stated, the octane-boosting additive may be substituted in at least one of the positions represented by $R_2$, $R_3$, $R_4$, $R_5$, $R_6$, $R_7$, $R_8$, $R_9$, $R_{11}$ and $R_{12}$, preferably in at least one of the positions represented by $R_6$, $R_7$, $R_8$ and $R_9$, and more preferably in at least one of the positions represented by $R_7$ and $R_8$. It is believed that the presence of at least one group other than hydrogen may improve the solubility of the octane-boosting additives in a fuel.

Also advantageously, no more than five, preferably no more than three, and more preferably no more than two, of $R_2$, $R_3$, $R_4$, $R_5$, $R_6$, $R_7$, $R_8$, $R_9$, $R_{11}$ and $R_{12}$ are selected from a group other than hydrogen. Preferably, one or two of $R_2$, $R_3$, $R_4$, $R_5$, $R_6$, $R_7$, $R_8$, $R_9$, $R_{11}$ and $R_{12}$ are selected from a group other than hydrogen. In some embodiments, only one of $R_2$, $R_3$, $R_4$, $R_5$, $R_6$, $R_7$, $R_8$, $R_9$, $R_{11}$ and $R_{12}$ is selected from a group other than hydrogen.

It is also preferred that at least one of $R_2$ and $R_3$ is hydrogen, and more preferred that both of $R_2$ and $R_3$ are hydrogen.

In preferred embodiments, at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ are selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

In further preferred embodiments, at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

Preferably, X is —O— or —$NR_{10}$—, where $R_{10}$ is selected from hydrogen, methyl, ethyl, propyl and butyl groups, and preferably from hydrogen, methyl and ethyl groups. More preferably, $R_{10}$ is hydrogen. In preferred embodiments, X is —O—.

n may be 0 or 1, though it is preferred that n is 0.

Octane-boosting additives that may be used in the present invention include:

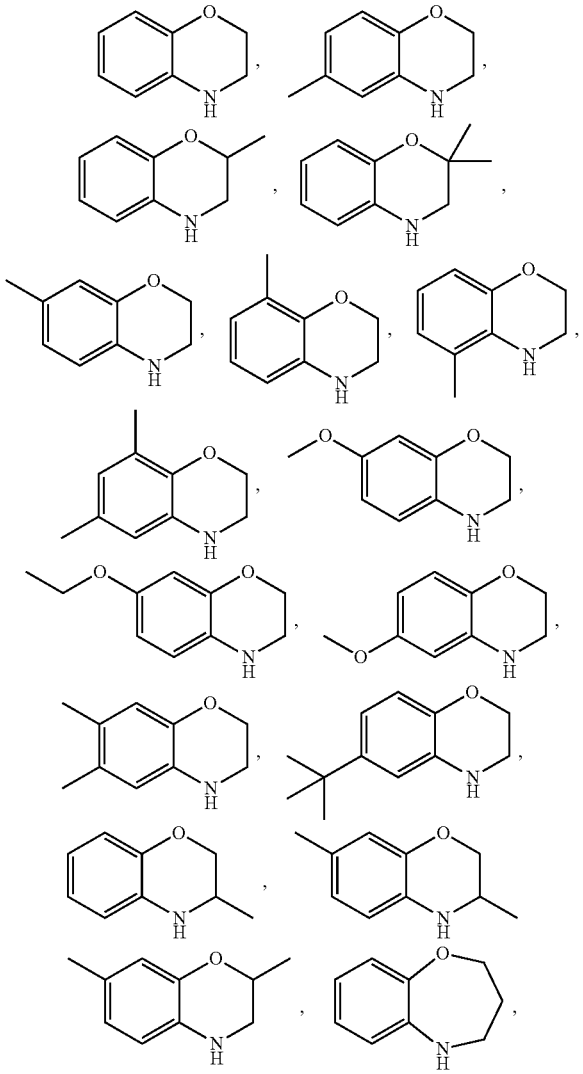

-continued

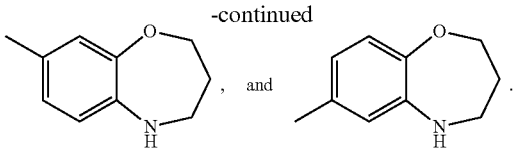

Preferred octane-boosting additives include:

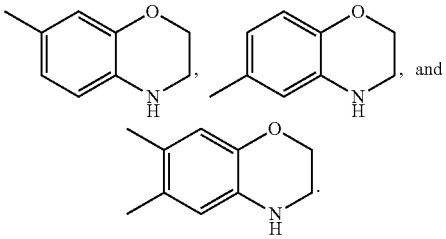

A mixture of additives may be used in the fuel composition. For instance, the fuel composition may comprise a mixture of:

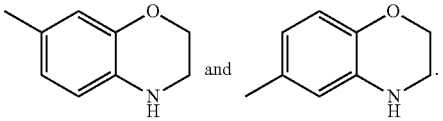

It will be appreciated that references to alkyl groups include different isomers of the alkyl group. For instance, references to propyl groups embrace n-propyl and i-propyl groups, and references to butyl embrace n-butyl, isobutyl, sec-butyl and tert-butyl groups.

Refinery Fuel Compositions

The methods of the present invention are used to prepare refinery fuel compositions for spark-ignition internal combustion engines.

It will be appreciated that the fuels may be used in engines other than spark-ignition internal combustion engines, provided that they are suitable for use in a spark-ignition internal combustion engine. Gasoline fuels (including those containing oxygenates) are typically used in spark-ignition internal combustion engines.

Examples of spark-ignition internal combustion engines include direct injection spark-ignition engines and port fuel injection spark-ignition engines. The spark-ignition internal combustion engine may be used in automotive applications, e.g. in a vehicle such as a passenger car.

The refinery fuel compositions prepared by the methods of the present invention comprise a blend of refinery streams and, preferably, one or more fuel additives.

The one or more refinery streams may be any streams that are produced in a refinery and that are suitable for use in a fuel for a spark-ignition, internal combustion engine. Preferably, the one or more refinery streams are produced in a crude oil refinery, though streams may also be obtained from other refineries, such as a biomass refinery, a gas-to-liquid refinery, a coal-to-liquid refinery, and other hydrocarbon chemical manufacturing facilities.

Examples of suitable refinery streams include reformate, alkylate, naphtha, butane, isomerate, hydrocrackate, catalytic cracked gasoline, pyrolis gasoline, raffinate, toluene and xylene, though it will be appreciate that a wide range of components may be used. Preferably, the one or more refinery streams are selected from reformate, alkylate, naphtha, butane and isomerate.

The refinery fuel compositions are preferably blended in a refinery, and more preferably in the same refinery in which the one or more refinery streams are produced.

The refinery fuel compositions may comprise a major amount (i.e. greater than 50% by weight) of the one or more refinery streams and a minor amount (i.e. less than 50% by weight) of one or more fuel additives.

Examples of fuel additives that may be present in the refinery fuel compositions include octane improvers, detergents, friction modifiers/anti-wear additives, corrosion inhibitors, combustion modifiers, anti-oxidants, valve seat recession additives, dehazers/demulsifiers, dyes, markers, odorants, anti-static agents, anti-microbial agents, pipeline flow-improvers, and lubricity improvers.

Examples of suitable octane improvers include non-metallic octane improvers, such as N-methyl aniline or derivatives thereof, ethers (e.g. MTBE, ETBE, tert-amyl methyl ether (TAME), tert-hexyl methyl ether (THEME), tert-amyl ethyl ether (TAEE) and diisopropyl ether (DIPE)), and nitrogen-based ashless octane improvers. Metal-containing octane improvers, such as methylcyclopentadienyl manganese tricarbonyl, ferrocene and tetra-ethyl lead, may also be used though the refinery fuel compositions are preferably free from all metallic octane improvers.

Another suitable octane improver is an octane-boosting additive described herein, i.e. having a chemical structure comprising a 6-membered aromatic ring sharing two adjacent aromatic carbon atoms with a 6- or 7-membered otherwise saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon. This octane-boosting additive is blended into fuels in the methods of the present invention.

Examples of suitable detergents include polyisobutylene amines (PIB amines) and polyether amines.

Examples of suitable friction modifiers and anti-wear additives include those that are ash-producing additives or ashless additives. Examples of friction modifiers and anti-wear additives include esters (e.g. glycerol mono-oleate) and fatty acids (e.g. oleic acid and stearic acid).

Examples of suitable corrosion inhibitors include ammonium salts of organic carboxylic acids, amines and heterocyclic aromatics, e.g. alkylamines, imidazolines and tolyltriazoles.

Examples of suitable anti-oxidants include phenolic anti-oxidants (e.g. 2,4-di-tert-butylphenol and 3,5-di-tert-butyl-4-hydroxyphenylpropionic acid) and aminic anti-oxidants (e.g. para-phenylenediamine, dicyclohexylamine and derivatives thereof).

Examples of suitable valve seat recession additives include inorganic salts of potassium or phosphorus.

Examples of suitable dehazers/demulsifiers include phenolic resins, esters, polyamines, sulfonates or alcohols which are grafted onto polyethylene or polypropylene glycols.

Examples of suitable markers and dyes include azo or anthraquinone derivatives.

Examples of suitable anti-static agents include fuel soluble chromium metals, polymeric sulfur and nitrogen compounds, quaternary ammonium salts or complex organic alcohols. However, the refinery fuel compositions are preferably substantially free from all polymeric sulfur and all metallic additives, including chromium based compounds.

In some embodiments, the refinery fuel compositions comprise solvent, e.g. which has been used to ensure that the additives are in a form in which they can be stored or combined with the refinery streams. Examples of suitable solvents include polyethers and aromatic and/or aliphatic hydrocarbons, e.g. heavy naphtha e.g. Solvesso (Trade mark), xylenes and kerosene.

Representative typical and more typical independent amounts of additives (if present) and solvent in the fuel composition are given in the table below. For the additives, the concentrations are expressed by weight (of the base fuel) of active additive compounds, i.e. independent of any solvent or diluent. Where more than one additive of each type is present in the fuel composition, the total amount of each type of additive is expressed in the table below.

| | Fuel Composition | |
|---|---|---|
| | Typical amount (ppm, by weight) | More typical amount (ppm, by weight) |
| Octane improvers | 1000 to 100000 | 2000 to 50000 |
| Detergents | 10 to 2000 | 50 to 300 |
| Friction modifiers and anti-wear additives | 10 to 500 | 25 to 150 |
| Corrosion inhibitors | 0.1 to 100 | 0.5 to 40 |
| Anti-oxidants | 1 to 100 | 10 to 50 |
| Dehazers and demulsifiers | 0.05 to 30 | 0.1 to 10 |
| Anti-static agents | 0.1 to 5 | 0.5 to 2 |
| Other additive components | 0 to 500 | 0 to 200 |
| Solvent | 10 to 3000 | 50 to 1000 |

In some embodiments, the refinery fuel composition comprises or consists of additives and solvents in the typical or more typical amounts recited in the table above.

The refinery fuel compositions prepared using the methods of the present invention may be fully formulated (also known as "finished grade"), or they may be intermediate compositions which are blended with one or more further components (e.g. one or more fuel additives, such as those described above, or alcohols such as ethanol) into fully formulated fuels.

In some embodiments, the refinery fuel composition is, or is blended into, an oxygenate fuel. Oxygenate fuels that may be used in a spark-ignition internal combustion engine contain oxygenate fuel components, such as alcohols and ethers. Suitable alcohols include straight and/or branched chain alkyl alcohols having from 1 to 6 carbon atoms, e.g. methanol, ethanol, n-propanol, n-butanol, isobutanol, tert-butanol. Preferred alcohols include methanol and ethanol. Suitable ethers include ethers having 5 or more carbon atoms, e.g. methyl tert-butyl ether and ethyl tert-butyl ether.

However, due to their hygroscopic nature, alcohols such as ethanol are typically not introduced into a fuel in a refinery, but are rather blended with a refinery fuel composition outside of the refinery, e.g. at a fuel terminal. Thus, the refinery fuel compositions prepared by the methods of the present invention will generally be free from ethanol, and more preferably free from alcohols.

In some preferred embodiments, the refinery fuel composition is blended into a fully formulated fuel composition that comprises ethanol, e.g. ethanol complying with EN 15376:2014. The fully formulated fuel composition may comprise ethanol in an amount of up to 85%, preferably from 1% to 30%, more preferably from 3% to 20%, and even more preferably from 5% to 15%, by volume. For instance, the fully formulated fuel composition may contain ethanol in an amount of about 5% by volume (i.e. an E5 fuel), about 10% by volume (i.e. an E10 fuel) or about 15% by volume (i.e. an E15 fuel). A fuel which is free from ethanol is referred to as an E0 fuel.

Ethanol is believed to enhance the solubility of the octane-boosting additives described herein. Thus, in some embodiments, for instance where the octane-boosting additive is unsubstituted (e.g. an additive in which $R_1$, $R_2$, $R_3$, $R_4$, $R_5$, $R_6$, $R_7$, $R_8$ and $R_9$ are hydrogen; X is —O—; and n is 0) it may be preferable to blend a refinery fuel composition comprising the octane-boosting additive with ethanol.

The refinery fuel composition may meet, or be blended into a fuel which meets, particular automotive industry standards. For instance, the fuel composition may have a maximum oxygen content of 2.7% by mass.

The refinery fuel composition may have, or be blended into a fully formulated fuel composition which has, maximum amounts of oxygenates as specified in EN 228, e.g. methanol: 3.0% by volume, ethanol: 5.0% by volume, iso-propanol: 10.0% by volume, iso-butyl alcohol: 10.0% by volume, tert-butanol: 7.0% by volume, ethers (e.g. having 5 or more carbon atoms): 10% by volume and other oxygenates (subject to suitable final boiling point): 10.0% by volume.

The refinery fuel composition may have, or be blended into a fully formulated fuel composition which has, a sulfur content of up to 50.0 ppm by weight, e.g. up to 10.0 ppm by weight.

The refinery fuel composition may be, or be blended into a fully formulated fuel compositions which is, a leaded or an unleaded fuel compositions. Preferred fuel compositions are unleaded.

In embodiments, the refinery fuel composition meets, or is blended into a fully formulated fuel composition that meets, the requirements of EN 228, e.g. as set out in BS EN 228:2012. In other embodiments, the fuel composition meets, or is blended into a fully formulated fuel composition that meets, the requirements of ASTM D 4814, e.g. as set out in ASTM D 4814-15a. It will be appreciated that the refinery fuel composition may meet, or is blended into a fully formulated fuel composition that meets, both requirements, and/or other fuel standards.

The refinery fuel composition may exhibit, or be blended into a fully formulated fuel composition which exhibits, one or more (such as all) of the following, e.g., as defined according to BS EN 228:2012: a minimum research octane number of 95.0, a minimum motor octane number of 85.0 a maximum lead content of 5.0 mg/l, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

The invention will now be described with reference to the following non-limiting examples and figures.

Figure 3:
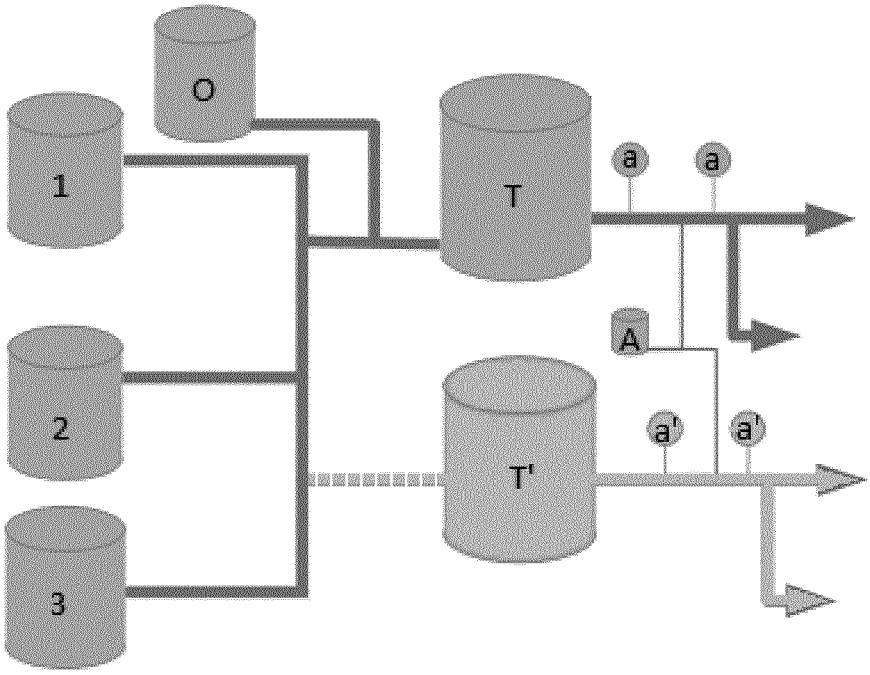
FIG. 3 is a diagram of a refinery system which may be used for carrying out the methods of the present invention.

FIG. 3 shows a refinery system in which three refinery streams (1, 2, 3) may be blended with an octane improver (O) to form a refinery fuel composition. The refinery fuel composition may be passed to a storage tank (T). Further fuel additives (A, a) may be added to the refinery fuel composition on discharge from the storage tank (T). FIG. 3 also shows a second storage tank (T'). Additives (A, a') may be added to a refinery fuel that is discharged from the second storage tank (T').

According to the first aspect of the invention, three refinery streams (1, 2, 3) are blended with an octane improver (O) in proportions which are designed to give a refinery fuel composition with an octane number which is greater than the target octane number by a margin of less than 1. The refinery fuel composition is passed to the storage tank (T), where its octane number is tested. If the octane number falls below the target octane number for the refinery fuel composition, an octane-boosting additive described herein is introduced to the refinery fuel composition as an additive (a) once it has been discharged from the storage tank (T).

According to the second aspect of the invention, a first refinery fuel composition is a blend of three refinery streams (1, 2, 3) and a low-oxygen octane-boosting additive described herein (O). This refinery fuel composition is passed to, and then discharged from, storage tank (T). Further fuel additives (A, a) may be blended with the refinery fuel composition once it has been discharged from storage tank (T).

A second refinery fuel composition is a blend of three refinery streams (1, 2, 3) and is intended for use in a non-oxygenate fuel. In prior art methods where ethers such as MTBE and ETBE are used as the octane boosting additive (O) in the first refinery fuel composition, the second refinery fuel composition would have been passed to storage tank (T') to avoid contamination with oxygenates. However, since a low-oxygen octane-boosting additive has been used in the first refinery fuel composition, the second refinery fuel composition is passed directly to storage tank (T).

EXAMPLES

Example 1: Preparation of Octane-Boosting Additives

The following low-oxygen octane-boosting additives were prepared using standard methods:

OX1

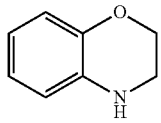

OX2

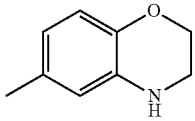

OX3

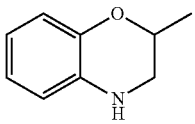

OX4

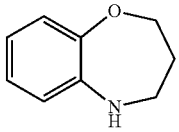

OX5

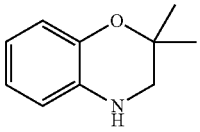

-continued

OX6

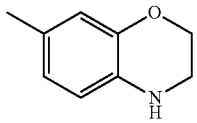

OX7

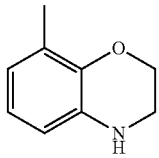

OX8

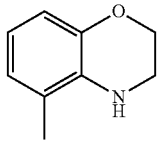

OX9

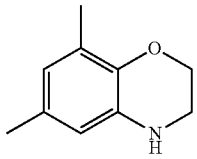

OX10

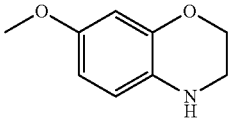

OX11

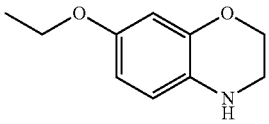

OX12

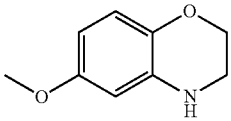

OX13

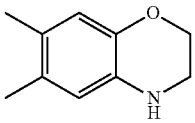

OX14

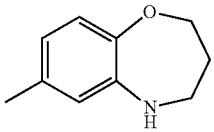

OX15

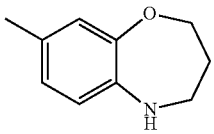

OX16

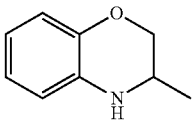

-continued

OX17

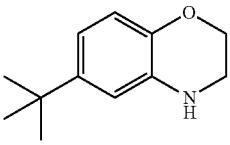

OX18

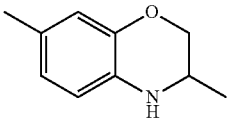

OX19

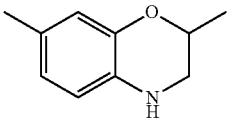

Example 2: Octane Number of Fuels Containing Octane-Boosting Additives

The effect of octane-boosting additives from Example 1 (OX1, OX2, OX3, OX5, OX6, OX8, OX9, OX12, OX13, OX17 and OX19) on the octane number of two different base fuels for a spark-ignition internal combustion engine was measured.

The additives were added to the fuels at a relatively low treat rate of 0.67% weight additive/weight base fuel, equivalent to a treat rate of 5 g additive/litre of fuel. The first fuel was an E0 gasoline base fuel. The second fuel was an E10 gasoline base fuel. The RON and MON of the base fuels, as well as the blends of base fuel and octane-boosting additive, were determined according to ASTM D2699 and ASTM D2700, respectively.

The following table shows the RON and MON of the fuel and the blends of fuel and octane-boosting additive, as well as the change in the RON and MON that was brought about by using the octane-boosting additives:

| | E0 base fuel | | | | E10 base fuel | | | |
|---|---|---|---|---|---|---|---|---|
| Additive | RON | MON | ΔRON | ΔMON | RON | MON | ΔRON | ΔMON |
| — | 95.4 | 86.0 | n/a | n/a | 95.4 | 85.2 | n/a | n/a |
| OX1 | — | — | — | — | 97.3 | 86.3 | 1.9 | 1.1 |
| OX2 | 97.7 | 87.7 | 2.3 | 1.7 | 97.8 | 86.5 | 2.4 | 1.3 |
| OX3 | 97.0 | 86.7 | 1.6 | 0.7 | 97.1 | 85.5 | 1.7 | 0.3 |
| OX5 | 97.0 | 86.5 | 1.6 | 0.5 | 97.1 | 85.5 | 1.7 | 0.3 |
| OX6 | 98.0 | 87.7 | 2.6 | 1.7 | 98.0 | 86.8 | 2.6 | 1.6 |
| OX8 | 96.9 | 86.1 | 1.5 | 0.1 | 96.9 | 85.7 | 1.5 | 0.5 |
| OX9 | 97.6 | 86.9 | 2.2 | 0.9 | 97.6 | 86.5 | 2.2 | 1.3 |
| OX12 | 97.4 | 86.3 | 2.0 | 0.3 | 97.3 | 86.1 | 1.9 | 0.9 |
| OX13 | 97.9 | 86.5 | 2.5 | 0.5 | 97.7 | 86.1 | 2.3 | 0.9 |
| OX17 | 97.5 | 86.4 | 2.1 | 0.4 | 97.4 | 86.4 | 2.0 | 1.2 |
| OX19 | 97.4 | 86.1 | 2.0 | 0.1 | 97.6 | 85.9 | 2.2 | 0.7 |

It can be seen that the octane-boosting additives may be used to increase the RON of an ethanol-free and an ethanol-containing fuel for a spark-ignition internal combustion engine.

Further additives from Example 1 (OX4, OX7, OX10, OX11, OX14, OX15, OX16 and OX18) were tested in the E0 gasoline base fuel and the E10 gasoline base fuel. Each of the additives increased the RON of both fuels, aside from OX7 where there was insufficient additive to carry out analysis with the ethanol-containing fuel.

Example 3: Variation of Octane Number with Octane-Boosting Additive Treat Rate

The effect of an octane-boosting additive from Example 1 (OX6) on the octane number of three different base fuels for a spark-ignition internal combustion engine was measured over a range of treat rates (% weight additive/weight base fuel).

The first and second fuels were E0 gasoline base fuels. The third fuel was an E10 gasoline base fuel. As before, the RON and MON of the base fuels, as well as the blends of base fuel and octane-boosting additive, were determined according to ASTM D2699 and ASTM D2700, respectively.

The following table shows the RON and MON of the fuels and the blends of fuel and octane-boosting additive, as well as the change in the RON and MON that was brought about by using the octane-boosting additives:

| | Additive treat rate | Octane number | | | |
|---|---|---|---|---|---|
| | (% w/w) | RON | MON | ΔMON | ΔMON |
| E0 90 RON | 0.00 | 89.9 | 82.8 | 0.0 | 0.0 |
| | 0.20 | 91.5 | 83.5 | 1.6 | 0.7 |
| | 0.30 | 92.0 | 83.6 | 2.1 | 0.8 |
| | 0.40 | 92.5 | 83.8 | 2.6 | 1.0 |
| | 0.50 | 92.9 | 83.8 | 3.0 | 1.0 |
| | 0.67 | 93.6 | 84.2 | 3.7 | 1.4 |
| | 1.01 | 94.7 | 85.0 | 4.8 | 2.2 |
| | 1.34 | 95.9 | 85.4 | 6.0 | 2.6 |
| | 10.00 | 104.5 | 87.9 | 14.6 | 5.1 |
| E0 95 RON | 0.00 | 95.2 | 85.6 | 0.0 | 0.0 |
| | 0.10 | 95.9 | 85.8 | 0.7 | 0.2 |
| | 0.20 | 96.4 | 86.3 | 1.2 | 0.7 |
| | 0.30 | 96.6 | 86.8 | 1.4 | 1.2 |
| | 0.40 | 97.1 | 86.6 | 1.9 | 1.0 |
| | 0.50 | 97.3 | 87.0 | 2.1 | 1.4 |
| | 0.60 | 97.5 | 86.8 | 2.3 | 1.2 |
| | 0.70 | 97.8 | 86.8 | 2.6 | 1.2 |
| | 0.80 | 98.0 | 87.3 | 2.8 | 1.7 |
| | 0.90 | 98.5 | 86.8 | 3.3 | 1.2 |
| | 1.00 | 98.7 | 86.9 | 3.5 | 1.3 |
| | 10.00 | 105.7 | 88.7 | 10.5 | 3.1 |
| E10 95 RON | 0.00 | 95.4 | 85.1 | 0.0 | 0.0 |
| | 0.10 | 95.9 | 85.2 | 0.5 | 0.1 |
| | 0.20 | 96.3 | 86.3 | 0.9 | 1.2 |
| | 0.30 | 96.8 | 86.3 | 1.4 | 1.2 |
| | 0.40 | 96.9 | 85.8 | 1.5 | 0.7 |
| | 0.50 | 97.3 | 85.9 | 1.9 | 0.8 |
| | 0.60 | 97.4 | 85.9 | 2.0 | 0.8 |
| | 0.70 | 97.9 | 86.0 | 2.5 | 0.9 |
| | 0.80 | 98.2 | 86.8 | 2.8 | 1.7 |
| | 0.90 | 98.7 | 86.3 | 3.3 | 1.2 |
| | 1.00 | 98.8 | 86.5 | 3.4 | 1.4 |
| | 10.00 | 105.1 | 87.8 | 9.7 | 2.7 |

Figure 1B:
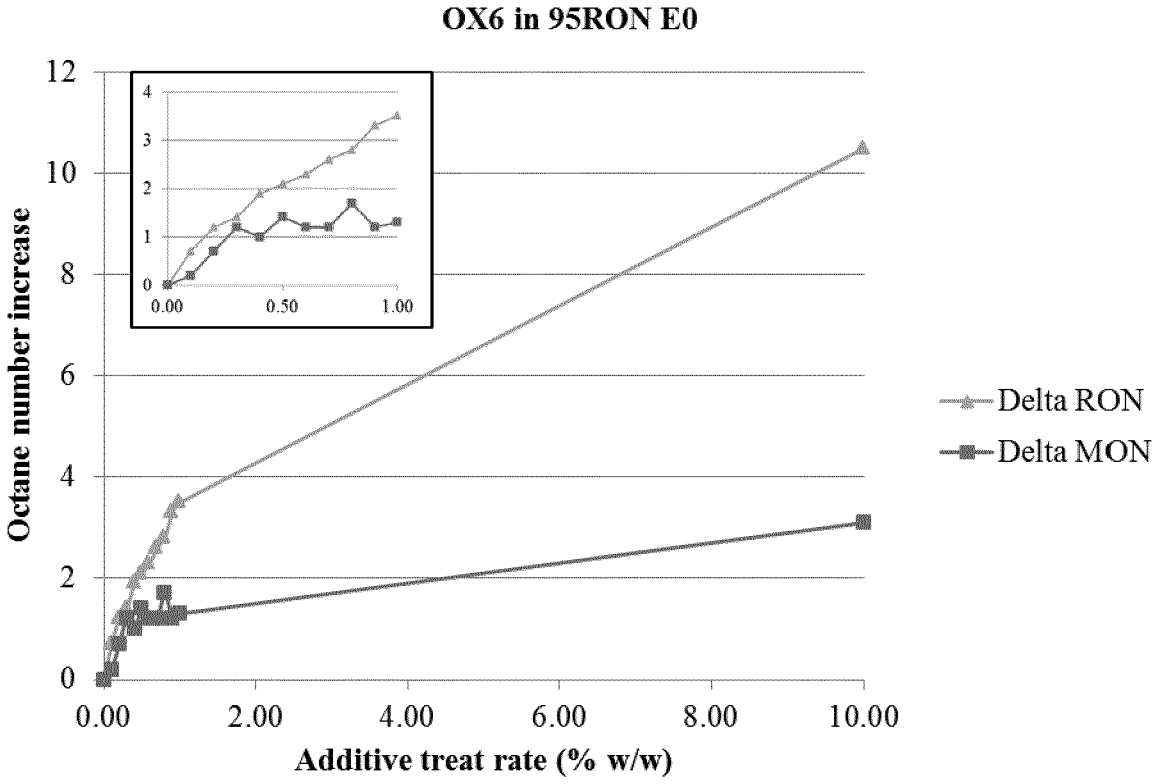
Figure 1C:
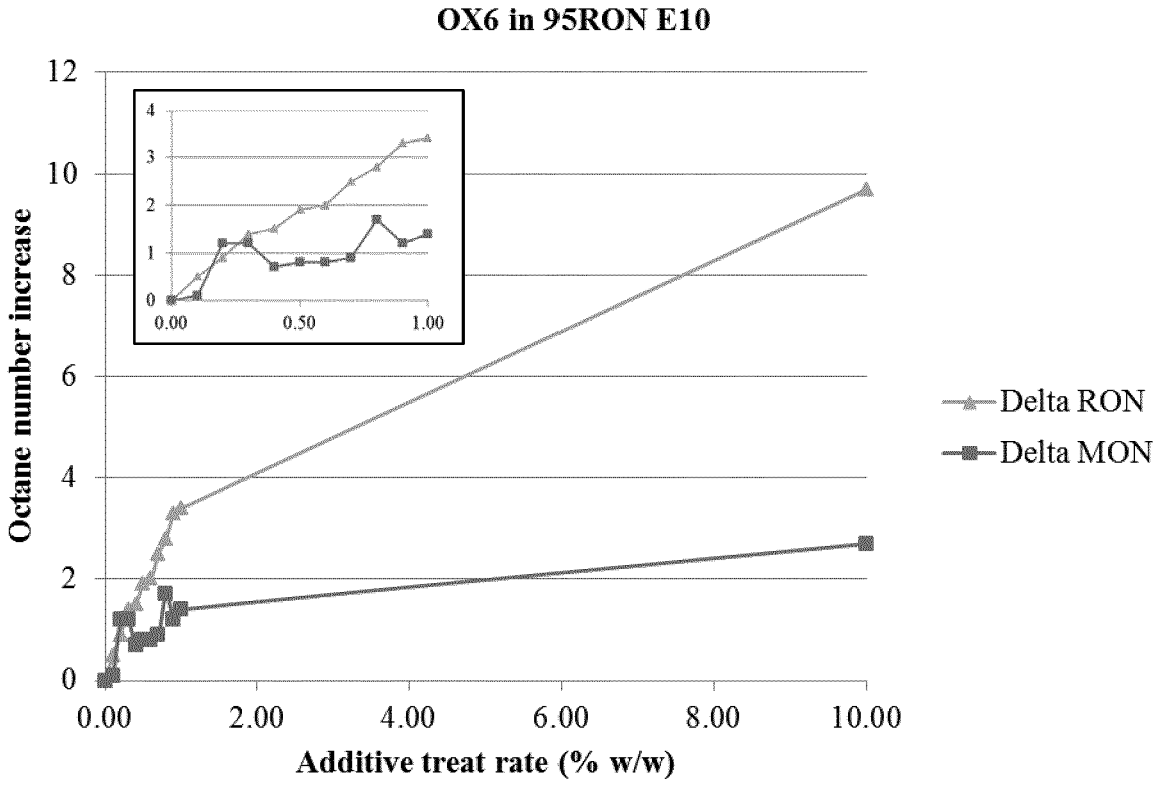

Graphs of the effect of the octane-boosting additive on the RON and MON of the three fuels are shown in FIGS. 1*a-c*. It can be seen that the octane-boosting additive had a significant effect on the octane numbers of each of the fuels, even at very low ppm treat rates.

Example 4: Comparison of Octane-Boosting Additive with N-Methyl Aniline

The effect of octane-boosting additives from Example 1 (OX2 and OX6) was compared with the effect of N-methyl aniline on the octane number of two different base fuels for a spark-ignition internal combustion engine over a range of treat rates (% weight additive/weight base fuel).

The first fuel was an E0 gasoline base fuel. The second fuel was an E10 gasoline base fuel. As before, the RON and MON of the base fuels, as well as the blends of base fuel and octane-boosting additive, were determined according to ASTM D2699 and ASTM D2700, respectively.

Figure 2A:
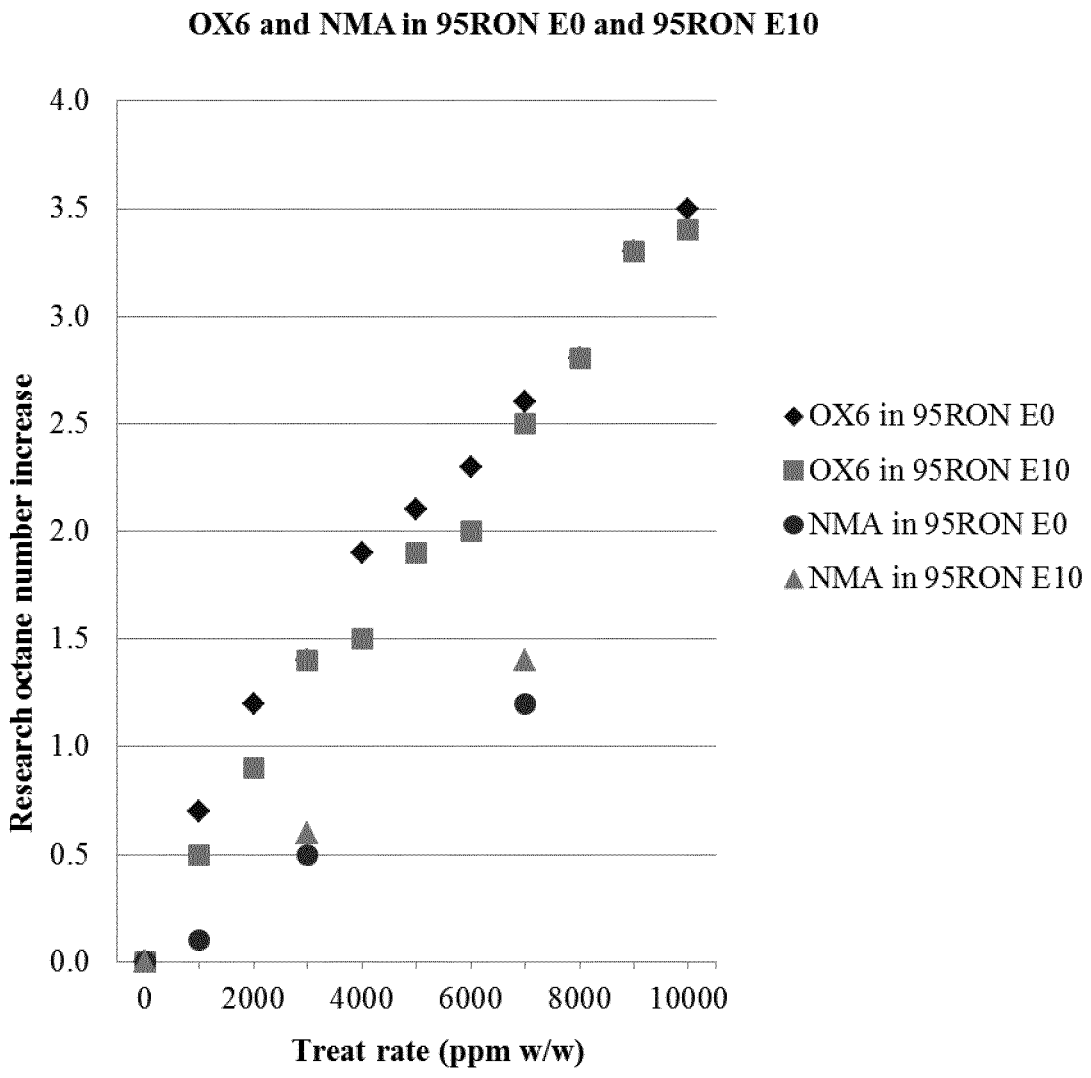
FIGS. 2*a-c* show graphs comparing the change in octane number (both RON and MON) of fuels when treated with octane-boosting additives described herein and N-methyl aniline. Specifically.

A graph of the change in octane number of the E0 and E10 fuels against treat rate of N-methyl aniline and an octane-boosting additive (OX6) is shown in FIG. 2*a*. The treat rates are typical of those used in a fuel. It can be seen from the graph that the performance of the octane-boosting additives described herein is significantly better than that of N-methyl aniline across the treat rates.

Figure 2B:
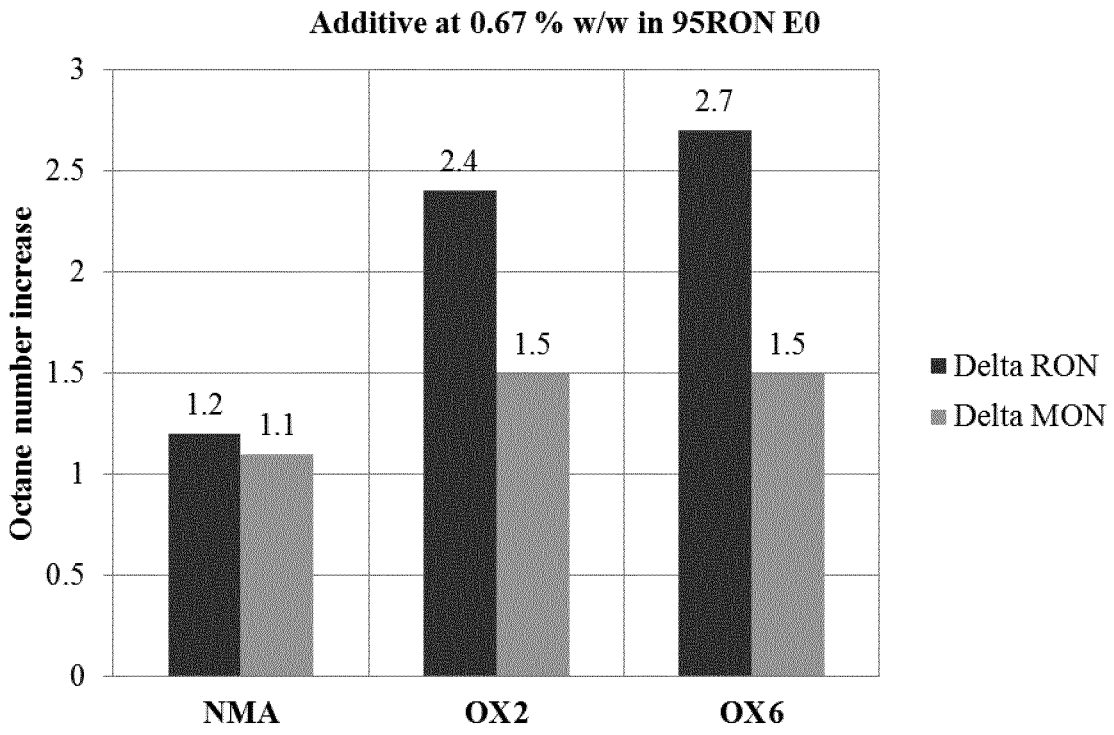
Figure 2C:
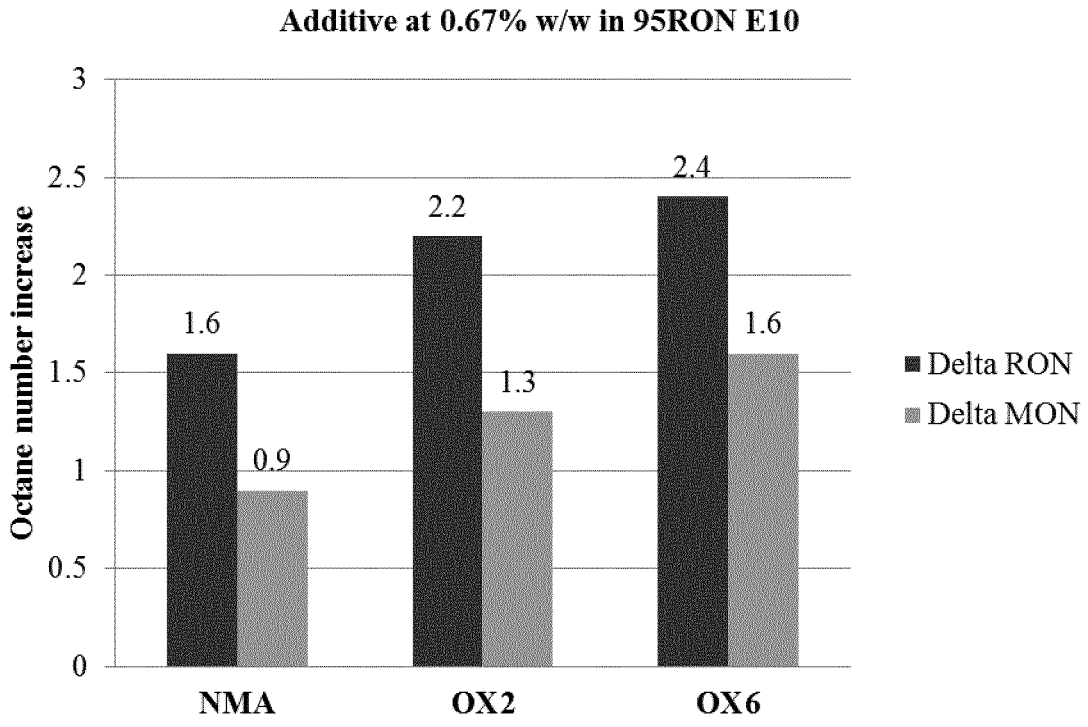

A comparison of the effect of two octane-boosting additives (OX2 and OX6) and N-methyl aniline on the octane number of the E0 and E10 fuels at a treat rate of 0.67% w/w is shown in FIGS. 2*b* and 2*c*. It can be seen from the graph that the performance of octane-boosting additives described herein is significantly superior to that of N-methyl aniline. Specifically, an improvement of about 35% to about 50% is observed for the RON, and an improvement of about 45% to about 75% is observed for the MON.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A method for preparing a refinery fuel composition for a spark-ignition internal combustion engine, the refinery fuel composition having a target octane number, said method comprising:

blending two or more refinery streams and optionally one or more fuel additives in proportions which are designed to give a refinery fuel composition with an octane number which is greater than the target octane number by a margin of less than 1;

(ii) testing the octane number of the refinery fuel composition; and (iii) blending the refinery fuel composition with an octane-boosting additive in an amount sufficient to increase the octane number of the refinery fuel composition to at least the target octane number;

wherein the octane-boosting additive has the following formula:

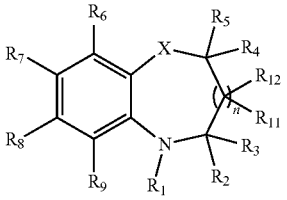

where:

$R_1$ is hydrogen;

$R_2$, $R_3$, $R_4$, $R_{11}$, and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

2. The method of claim 1, wherein the margin is of less than 0.5.

3. The method of claim 1, wherein the one or more fuel additives includes an additional octane improver selected from a non-metallic octane improver, nitrogen-based ashless octane improvers, and the octane-boosting additive used in step (iii).

4. The method of claim 1, wherein the octane-boosting additive is blended with the refinery fuel composition in an amount of less than 5000 ppm by total weight of the refinery streams.

5. The method of claim 1, wherein the target octane number is a target research octane number (RON) having a value of from 90 to 105.

6. The method of claim 1, wherein the target octane number is a target anti-knock index (AKI) having a value of from 85 to 100.

7. The method of claim 1, wherein the one or more refinery streams are selected from reformate, alkylate, naphtha, butane, isomerate, hydrocrackate, catalytic cracked gasoline, pyrolysis gasoline, raffinate, toluene and xylene.

8. The method of claim 1, wherein X is —O—.

9. A method according to claim 1, wherein $R_2$, $R_3$, $R_4$, $R_5$, $R_{11}$ and $R_{12}$ are each independently selected from hydrogen and alkyl groups.

10. A method according to claim 1, wherein $R_6$, $R_7$, $R_8$ and $R_9$ are each independently selected from hydrogen, alkyl and alkoxy groups.

11. A method according to claim 1, wherein at least one of $R_2$, $R_3$, $R_4$, $R_5$, $R_6$, $R_7$, $R_8$, $R_9$, $R_{11}$ and $R_{12}$ is selected from a group other than hydrogen.

12. A method according to claim 1, wherein no more than five of $R_2$, $R_3$, $R_4$, $R_5$, $R_6$, $R_7$, $R_8$, $R_9$, $R_{11}$ and $R_{12}$ are selected from a group other than hydrogen.

13. A method according to claim 1, wherein at least one of $R_2$ and $R_3$ is hydrogen.

14. A method according to claim 1, wherein at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

15. A method according to claim 14, wherein at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

16. A method according to claim 1, wherein X is —O— or —$NR_{10}$—, where $R_{10}$ is selected from hydrogen, methyl, ethyl, propyl and butyl groups.

17. A method according to claim 1, wherein n is 0.

18. A method according to claim 1, wherein $R_1$ is hydrogen.

19. A method according to claim 1, wherein the octane-boosting additive is selected from:

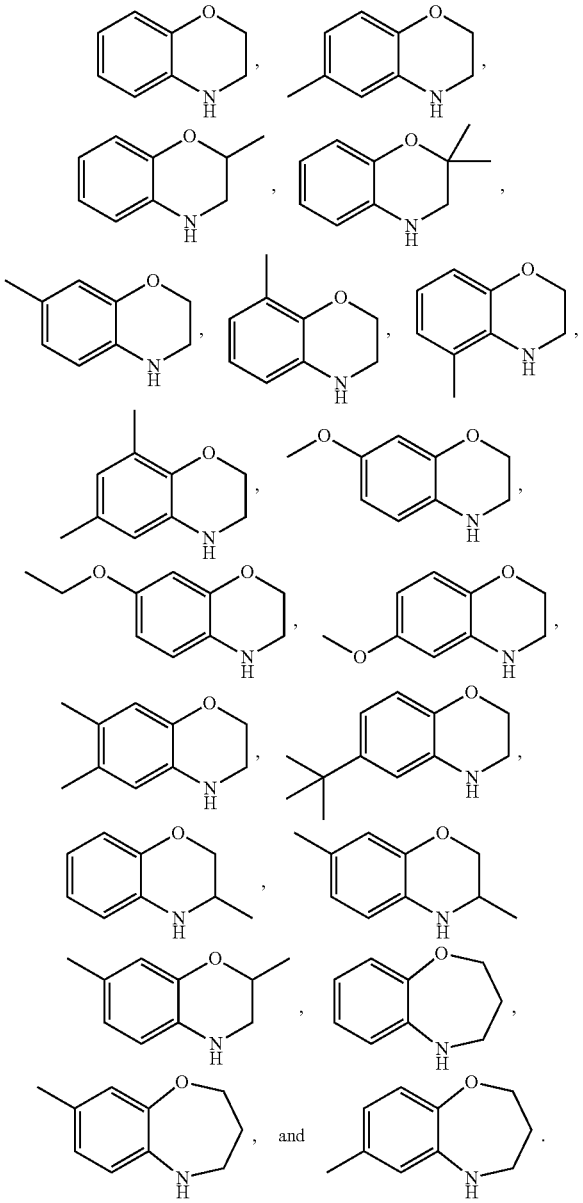

* * * * *